United States Patent [19]

Etourmy et al.

[11] Patent Number: 4,957,162

[45] Date of Patent: Sep. 18, 1990

[54] DEVICE FOR ANCHORING A PROBE IN A WELL BY SPREADING MOBILE ANCHORAGE ARMS

[75] Inventors: Noël Etourmy, Saint Gaudens; Jean Laurent, Orgeval, both of France

[73] Assignees: Institut Francais du Petrole, Rueil-Malmaison; Ateliers Mecaniques mde Saint Gaudens "A.M.G.", Saint Gaudens, both of France

[21] Appl. No.: 357,994

[22] Filed: May 30, 1989

[30] Foreign Application Priority Data

May 30, 1988 [FR] France ..... 88 07275

[51] Int. Cl.[5] ..... E21B 23/04

[52] U.S. Cl. ..... 166/212; 166/217; 166/242

[58] Field of Search ..... 166/212, 381, 65.1, 166/206, 55, 214, 215, 216, 217, 242, 243, 250; 175/292, 325, 263, 382, 384, 291, 274, 275

[56] References Cited

U.S. PATENT DOCUMENTS

| | | | |
|---|---|---|---|
| 3,052,297 | 9/1962 | Blydorp | 166/136 |
| 3,177,938 | 4/1965 | Roussin | 166/120 |
| 3,294,171 | 12/1966 | Kelley | 166/120 |
| 3,628,569 | 12/1971 | Urbanoksy | 251/205 |
| 4,428,422 | 1/1984 | Laurent | 166/212 |
| 4,616,703 | 10/1986 | Laurent et al. | 166/214 |
| 4,715,469 | 12/1987 | Yasuda et al. | 166/212 |

*Primary Examiner*—Bruce M. Kisliuk
*Assistant Examiner*—Terry Lee Melius
*Attorney, Agent, or Firm*—Antonelli, Terry, Stout & Kraus

[57] ABSTRACT

A device is provided for anchoring a probe in a well by remote control spreading, from the surface, of at least one anchorage arm kept in a closed position by a retractable bolt engaged in a rod connected to the anchorage arm by links. The external pressure is exerted permanently on the bolt and the bolt is fast with a head movable in a cavity. A pressure is applied to the head which is proportional to the external pressure which holds the bolt locked in the rod or a much lower pressure resulting in release of the bolt.

4 Claims, 2 Drawing Sheets

DEVICE FOR ANCHORING A PROBE IN A WELL BY SPREADING MOBILE ANCHORAGE ARMS

BACKGROUND OF THE INVENTION

The present invention relates to a device for anchoring a probe in a well by spreading mobile anchorage arms which are applied against the walls.

An anchorage device of the aforementioned type as described in, for example, French Patent No. 2,548,727 and corresponding to U.S. Pat. No. 4,616,703, wherein at least one spring is provided, with a rod being driven in a translatory motion by expansion of the spring. Means are provided for transforming the translational movement of the rod into a pivoting movement of the anchorage arm, and means are provided for intermittently immobilizing the rod in a position in which the spring is compressed, with the immobilization means comprising a bolt adapted to be engaged in a radial recess of the rod in the compressed position of the spring and hydraulic means for moving the bolt, of an anchorage arm, and means are provided for intermittently immobilizing the rod in a position in which the spring is compressed, with the immobilization means comprising a bolt adapted to be engaged in a radial recess of the rod in the compresed position of the spring and hydraulic means for moving the bolt.

The hydraulic means may comprise a cavity formed in the body of the apparatus, a head fast with the bolt in translation and adapted to slide into the cavity, and a hydraulic circuit for intermittently applying unequal pressures to the two opposite faces of the head, with one of the two pressures being equal to the pressure prevailing in the well at the chosen depth where the apparatus is immobilized. The application of the two unequal pressures is provided, for example, by means of an electrovalve.

Since the device is most often used at a depth of several hundred meters where the pressure is high, the force to which the bolt is subjected because of the differential pressure applied to the piston is considerable and permits a very reliable and very clean tripping of opening of the arms.

However, it has been discovered that accidental tripping could occur although the electrovalve is in a closed position and isolates the bolt from the well pressure. This can be attributed to sealing defects which place the hydraulic fluid of the bolt control circuit unexpectedly at an equal pressure with the pressure prevailing in the well and causes the bolt to recoil.

SUMMARY OF THE INVENTION

An object of the present invention resides in providing a new anchorage device for anchoring a probe and a well by spreading mobile anchorage arms against walls of the well which avoids, by simple means, an untimely tripping of each anchorage arm.

The hydraulic means, as in the embodiment of the above-described French patent includes a cavity formed in the body of the apparatus, with a head being fast with the bolt in translation being adapted to slide in and with a cavity, the section of the head being greater than that of the bolt, and a hydraulic circuit for applying a variable pressure to the head of the bolt.

A pressure application means is provided for permanently applying to the bolt a pressure equal to the pressue prevailing in the well and to the head fast with the bolt an opposite pressure which may vary between a first pressure whose value is sufficient to move the bolt towards its engagement position in the radial recess of the rod, and a second fairly low value so that the bolt is pushed towards its released position.

The pressure application means comprise, for example, a duct opening into the cavity on the side of the head opposite the bolt and switching means for selectively applying to the head the first pressure or the second pressure.

The pressure application means comprise a first and a second chamber of different sections formed in the body of the probe, a first and a second piston of different sections adapted respectively to the section of the first and second chambers, with the first smaller section piston being permanently exposed to the pressure in the well, and the second chamber in which the second piston moves communicating with said duct, which is connected intermittently through an electro valve to a volume where a pressure prevails less than the pressure prevailing in the well.

With such an arrangement, any possible leak which would place the fluid in the duct at a pressure identical to that which prevails in the well can only further increase the resultant forces applied to the bolt and head assembly and which hold it in the locked position and any unexpected tripping becomes impossible.

BRIEF DESCRIPTION OF THE DRAWINGS

Other objects, features, and advantages of the anchoring device of the present invention will become more apparent from the following description when taken in connection with the accompanying drawings which show, for the purpose of illustration only, one embodiment in accordance with the present invention, and wherein.

DESCRIPTION OF THE PREFERRED EMBODIMENT

Figure 2:
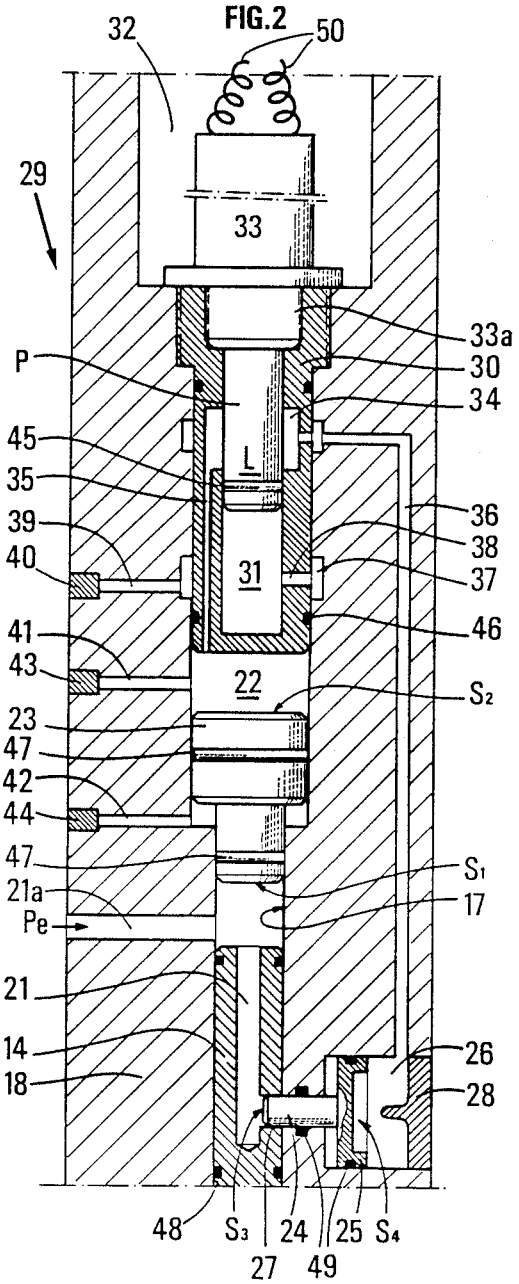
FIG. 2 is a partial cross-sectional detailed view of the pressure application means of the present invention in a position for locking the anchorage arm in the closed position.
Figure 1:
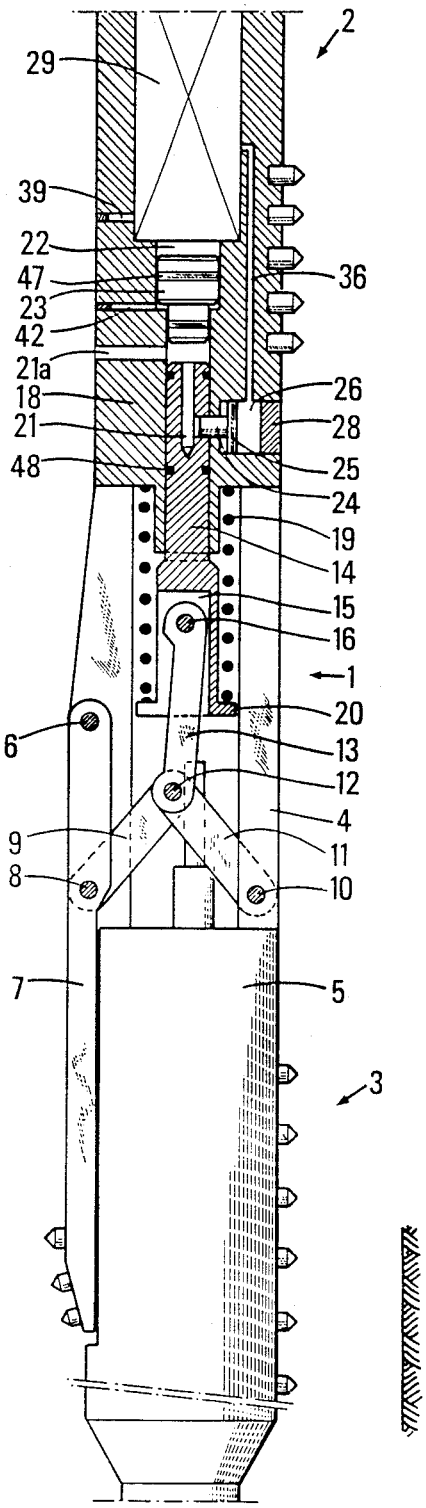
FIG. 1 is a partial longitudinal cross-sectional view of a probe with the anchorage device of the present invention in the locked position holding an anchorage arm closed.

Referring now to the drawings wherein like reference numerals are used throughout the various views to designate like parts and, more particularly to FIGS. 1 and 2, according to these figures, an anchorage device of the present invention is associated with a tubular probe generally designated by the reference numeral 1 having an upper part generally designated by the reference numeral 2 and a lower part generally designated by the reference numeral 3, with the tubular probe 1, upper part 2, and lower part 3 being made fast with each other by several bars 4.

The measuring apparatus formed, for example, of geofoams, is contained in a compartment 5 in the lower part 3 of the probe 1 and is connected to a multi-function cable supporting the probe 1 by electric conductors (not shown) passing, for example, inside the bars 4. One of the bars 4 comprises a pin 6 about which an anchorage arm 7 may pivot. A first end of a first operarting arm 9 is articulated on a pin 8 fixed to the anchorage arm 7 at a certain distance from the pin 6. A first end of a second operating arm 11 is articulated on a pin 10 fast with another bar 4, with the second ends of the two operating arms 9, 11 being adapted to pivot with respect to a common pin 12. A first end of a third operating arm 13 is pivotally mounted on the common pin 12.

The anchorage device also comprises a rod 14 having a recess 15 in the bottom of which is fixed an articulation pin 16 for the second end of the third operating arm 13. The rod 14 may slide in a cylindrical guide housing 17 formed in the axis of the body 18 of the probe 1.

A helical spring 19 bearing by a first end on the body of the probe 1 and by a second end on a shoulder 20 of rod 14 exerts on the latter rod 14 a force tending to cause the rod 14 to leave a guide housing generally designated by the reference numeral 17. An axial channel 21 is formed in the upper part of rod 14 and communicates with a radial bore 21A opening externally of the body 18.

The upper part of guide housing 17 is extended by a chamber 22 of larger section containing a hydraulic liquid. A piston 23 formed of two parts of different sections 51 and 52 is adapted to slide freely and sealingly in chamber 22 and the upper part of the guide housing 17, under the action of the possible pressure difference between the pressure of the hydraulic liquid and the pressure prevailing in the well, so as to cancel out this pressure difference.

The device further comprises a bolt 24 having a head 25 of larger section movable inside a cylindrical cavity 26 formed radially in body 18 of the probe 1, between a retracted position in which the bolt 24 is entirely retracted inside said body 18 and an extended position in which the bolt 14 projects inside the guide housing 17. A recess 27 (FIGS. 3, 4) is formed radially in rod 14 for bolt 24. It opens into the central channel 21 of rod 14 and thus a pressure Pe, prevailing in the well, is permanently applied to the bolt 24 on the rod 14 side. Cavity 26 is closed outwardly by a plug 28. The dimensions of the control arms and the position of the articulation pins 8, 10, 12 and of housing 27 are chosen so that, when the anchorage arm 7 is in the closed position along the body of the probe 1, the helical spring 19 is tensioned and the bolt 24 is engaged in the recess 27.

Figure 4:
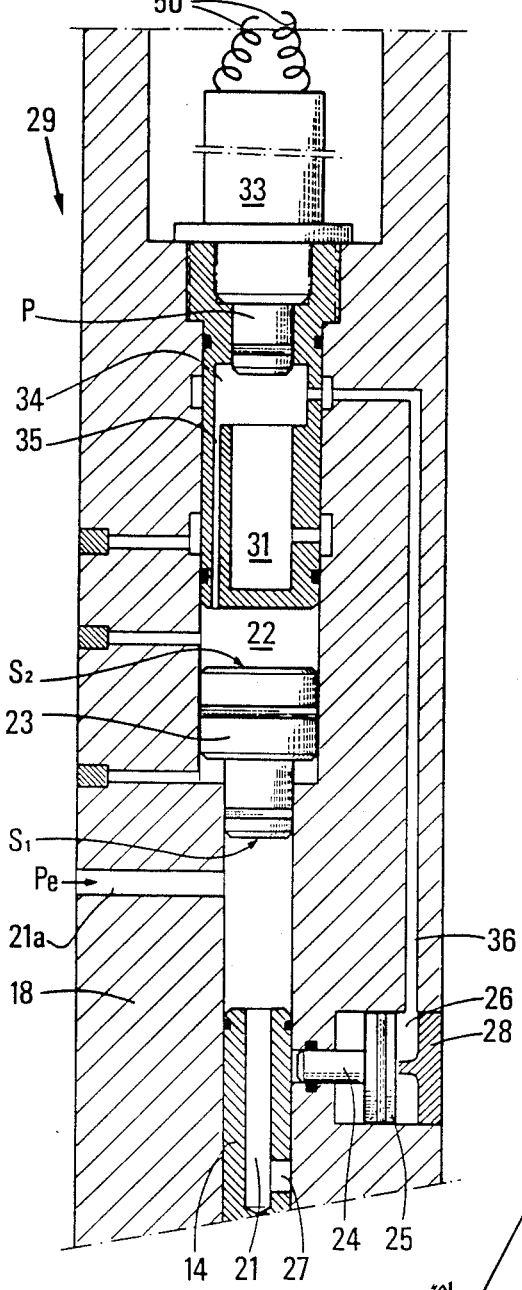
FIG. 4 is a partial cross-sectional detailed view of the pressure application menas in a position for tripping the anchorage bolt of the anchorage device of the present invention.

The pressure application means permitting unlocking of arm 27 are disposed in a housing generally designated by the reference numeral 29 of the body 18, the detail of which is shown most clearly in FIGS. 2 and 4, with the pressurre application means comprising a tubular added piece 30 of a section adapted to that of chamber 22 and fixed therein by threading. Piece 30 comprises a cylindrical inner cavity 31 closed on the piston 23 side and open on the opposite side. Chamber 22 is extended by another chamber 32 of larger section and in chamber 32 is disposed an electrovalve 33 having a threaded connection 33A which is threaded on to the tubular piece 30 at its open end. The electrovalve 33 comprises a mobile piston L whose section is adapted to that of cavity 31.

A circular groove 34 is formed in the wall of the tubular piece 30 about piston L. A first longitudinal duct 35 causes the groove 34 and chamber 22 to communicate with each other between the free piston 23 and the closed end of the tubular piece 30. Through a second duct 36 formed longitudinally in the wall of body 18, groove 34 communicates with cavity 26 where the head 25 of the bolt moves. A second circular groove 37 is formed in the inner wall of chamber 22 about the added piece 30. A first radial bore in the wall of the added piece 30 causes the inner cavity 31 to communicate with the groove 37. A second groove 39, in the external wall of the body 18 causes the groove 37 to communicate with the outside of the probe, with the second bore 39 being closed by a threaded plug 40. Two other radial bores 41 and 42 are also formed in the wall of the body 1, and at a first end, thereof open externally of the body 1 and at a second end thereof, respectively closed by two threaded plugs 43, 44. At their opposite end, they communicate respectively with the two parts of chamber 22 on each side of the free piston 23, the first on the added piece 30 side, the second on the same side as channel 21 in rod 14.

Seals 44, 45, 46, 47, 48, 49 are disposed respectively about piston P, the added piece 30, piston 23, rod 14 and bolt 24 for providing sealed sliding thereof.

The electrovalve 33 is connected by conductors 50 to a transmission line included in the electric supply and support cable (not shown). In the rest position, the piston L is in an extended position (FIGS. 1, 2) and isolates the inside of cavity 31 from groove 34.

When the electrovalve 33 is activated, piston L recoils sufficiently (FIGS. 3, 4) so as to cause cavity 31 to communicate with groove 34 and so with duct 36.

When the electrovalve 33 is in a rest position, the external pressure Pe is exerted through channel 21 in rod 14 and recess 27 on the smaller section face S2 of the free piston 23 and on the bolt 24 of section S3.

The hydraulic liquid pressure in chamber 22 on the side of the free piston 23 opposite rod 14 is reduced in the ratio S1/S2. This reduced hydraulic pressure is transmitted into cavity 26 through ducts 35 and 36 and is exerted on head 29 fast with the bolt 24, whose section is S4. The resultant force Fr applied to bolt 24 may be expressed by the following relationship.

$$Fr = \left( S3 - S4 \frac{S1}{S2} \right) Pe \quad (1)$$

The different sections S1 to S4 are chosen so that the force Fr is centripetal and results in driving the bolt into recess 27 (FIGS. 3, 4) of the rod 14 in the closed position of the anchorage arm 7.

With the probe on the surface and the electrovalve 33 closed so as to isolate the inner chamber 31, the threaded plug 40 is opened so as to drain the oil which it may contain and it is filled with a low pressure p (atmospheric pressure for example). Through channel 42 a vacuum is created in the portion of chamber 22 opposite the added piece 30.

Oil is injected into chamber 22 through duct 41 in a sufficient amount to fill ducts 35, 36, groove 34 and cavity 26 and to drive out the air.

The resultant force Fr exerted on the bolt 24 in accordance with the above relationship (1) is sufficient to push the bolt 24 against rod 14. When the anchorage arm 7 is brought to a closed position against the wall of the body (FIG. 7) by compressing the helical spring 19, the rod 14 is caused to retract inside its guide housing 17 as far as the reset position where bolt 24 is driven into the recess whereby the anchorage arm 7 is locked.

To check the locking of the anchorage arm 7, a relatively high hydraulic pressure may leasft momentarily be injected into chamber 22 and cavity 26.

The probe is then lowered into the well and, as it descends, the external pressure increases, with a recoil of the free piston 23 inside chamber 22 under the action of this pressure which is applied thereto through the axial channel 21 making it possible at all times to equalize the pressure of the hydraulic liquid contained in chamber 22 with the pressure prevailing in the well.

Figure 3:
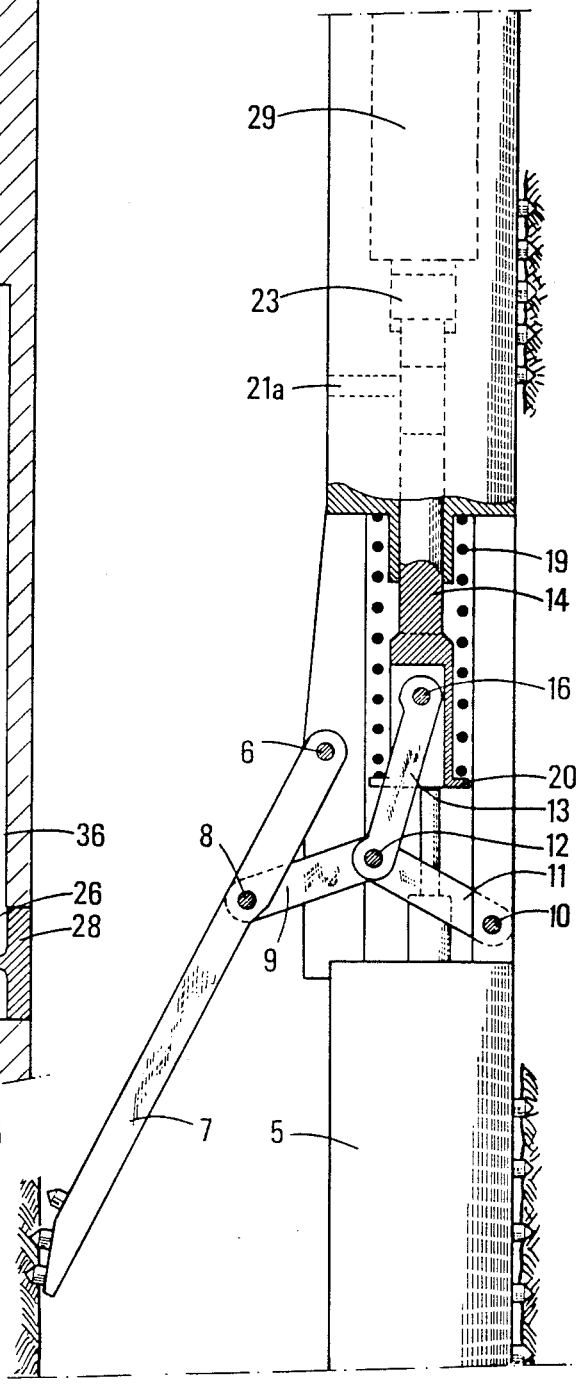
FIG. 3 is a partial longitudinal cross-sectional view of an anchorage device in accordance with the present invention which has been tripped for moving the anchorage arm away.

When the probe 1 has reached the chosen depth at which it is to be anchored, the electrovalve 33 is actuated so that piston P recoils (FIGS. 3, 4) and places ducts 35, 36 in communication with the inner cavity 31 at a very low pressure p. The bolt 24 is subjected on the axial channel 21 side to a force equal to Pe53 and, on the opposite side, to a force equal to P54. The resultant is a centrifugal force sufficient to overcome the friction forces of the bolt 24 in its recess 27 of the rod 14 and drive it to its retracted position (FIGS. 3, 4).

Rod 14 is released and, under the action of the helical spring 19, is pushed outwardly of the guide housing 17. The pivoting of the control arm 9, 11, 13 resulting from this movement results in causing the anchorage arm 7 to pivot and, when it is applied against the wall, in pressing the probe 1 against the opposite wall of the well whereby the apparatus contained in the probe 1 may then be used.

One of the oppositely acting pressures exerted on the bolt 24 and the head 25 is constantly equal to and the other proportional to the external pressure and possible leaks cannot change the direction of the resultant of the forces which hold them in the locked position.

Without departing from the scope of the invention, the same hydraulic system may be used for controlling the simultaneous unlocking of several anchorage arms such as the anchorage arm 7.

What is claimed is:

1. A device for anchoring a probe means in a well, the device comprising at least one anchorage arm adapted to be pivoted with respect to a body of the probe means, at least one spring means, a rod means driven in a translatory motion by expansion of the spring means, means for transforming the translatory movement of the rod means into a pivoting movement of the at least one anchorage arm means, means for intermittently immobilizing the rod means in a compressed position of the spring means comprising a bolt means adapted to be engaged in a radial recess means of the rod means in the compressed position of the spring means, and hydraulic means for moving the bolt means towards a release position when the rod means is released, said hydraulic means comprising a cavity means formed in the body of the probe means, a head means fast with the bolt means in translation and adapted to slide in said cavity means, a section of said head means being greater than a section of the bolt means, and a hydraulic circuit means for applying a variable pressure to the head means of the bolt means, and wherein pressure application means are provided for permanently applying to the bolt means a pressure equal to a pressure prevailing in the well and an opposite pressure to the head means which may vary between a first pressure increasing as the probe means is lowered into the well and having a value sufficient to move the bolt means toward said engagement position in the radial recess means of the rod means, and a second low pressure so that the bolt means is pushed towards said released position.

2. A anchorage device for anchoring a probe means in a well, the anchorage device comprising at least one anchorage arm adapted to be pivoted with respect to a body of the probe means, at least one spring means, a rod means driven in a translatory movement by expansion of the spring means, means for transforming the translatory movement of the rod means into a pivoting movement of the at least one anchorage arm means, means for intermittently immobilizing the rod means in a compressed position of the spring means comprising a bolt means adapted to be engaged in a radial recess means of the rod means in the compressed position of the spring means, and hydraulic means for moving the bolt means towards a release position when the rod means is released, said hydraulic means comprising a cavity means formed in the body of the probe means, a head means fast with the bolt means in translation and adapted to slide in said cavity means, a section of said head means being greater than a section of the bolt means, and a hydraulic circuit means for applying a variable pressure to the head means of the bolt means, wherein pressure application means are provided for permanently applying to the bolt means a pressure equal to a pressure prevailing in the well and an opposite pressure to the head means which may vary between a first pressure having a value sufficient to move the bolt means toward said engagement position in the radial recess means of the rod means, and a second low pressure so that the bolt means is pushed toward said release position, and wherein the hydraulic circuit means comprises a duct means opening into the cavity means on a side of the head means opposite to the bolt means, and switching means for selectively applying the first pressure or the second pressure to said head means.

3. The anchorage device as claimed in claim 2, wherein said pressure application means comprises a first chamber means and a second chamber means of different sections formed in the body of the probe means, a piston means comprising two parts of different sections adapted respectively to the sections of the first chamber means and the second chamber means, a smaller section part of the piston means being permanently exposed to the pressure in the well, wherein the second chamber means in which a largest section part of the piston means moves communicating with said duct means, which is connected to a volume where a pressure prevails less than the pressure prevailing in the well through an electrovalve means, and wherein the pressure application means further comprises opening means for applying the external pressure to the bolt means.

4. The anchorage device as claimed in claim 3, wherein said pressure application means further comprises an added piece with an inner cavity means, a piston associated with the electrovalve means and movable between a position closing the inner cavity means and a position in which said inner cavity means is placed in communication with said second chamber means and said cavity means formed in the body of the probe means, in which the head means of the bolt means moves.

* * * * *